United States Patent [19]

Hunley, Jr.

[11] 3,977,135

[45] Aug. 31, 1976

[54] SAFETY GUTTER PROTECTION DEVICE

[76] Inventor: Robert M. Hunley, Jr., 68 Plymouth St., Hartford, Conn. 06114

[22] Filed: Apr. 17, 1975

[21] Appl. No.: 569,191

[52] U.S. Cl. ..... 52/12; 210/474

[51] Int. Cl.[2] ..... E04D 13/00

[58] Field of Search ..... 210/163, 455, 473, 474, 210/475; 52/12; 248/48.1; 24/81

[56] References Cited

UNITED STATES PATENTS

| | | | |
|---|---|---|---|
| 2,469,841 | 5/1949 | Ours | 52/12 |
| 2,542,155 | 2/1951 | Moller | 52/12 |
| 2,841,100 | 7/1958 | Moller | 210/474 |
| 3,420,378 | 1/1969 | Turner | 52/12 |
| 3,834,091 | 9/1974 | Dugan | 52/12 |

*Primary Examiner*—Theodore A. Granger

[57] ABSTRACT

This device consists primarily of a screen hingedly secured to one side of a gutter, the hinges being spring loaded so as to keep the screen biased downwardly against the gutter until it is desired to lift it upwards by cable means so as to remove the debris from the screen. The device includes a fixed sleeve having an eye with pulley means therein which is in rolling engagement with the cable that serves to lift the screen.

3 Claims, 4 Drawing Figures

SAFETY GUTTER PROTECTION DEVICE

This invention relates to protective devices and more particularly to a safety gutter protection device.

It is therefore the principal object of this invention to provide a safety gutter protection device which will prevent debris such as leaves and other falling objects from entering the gutter that carries off the rain from the roof of a house or the like.

Another object of this invention is to provide a protection device as above described which will consist of a frame having screen means secured thereto for covering the gutter and hinge means secured to one side of the gutter secured also to the screen, and the hinge means are spring biased, thus keeping the screen covering the gutter until it is desired to lift the screen.

Still another object of this invention is to provide a protection device of the type described which will be activated by cable means and pulley means when it is desired to empty the leaves and other debris from the screen to fall to the ground.

Yet another object of this invention is to provide a protection device of the type described which will protect the home owner's gutters and will help young and old alike by avoiding the necessity of climbing to the roof to clean the gutters, old or new.

Other objects of the invention are to provide a safety gutter protection device which is simple in design, inexpensive to manufacture, rugged in construction, easy to use and efficient in operation.

These and other objects will become readily evident upon a study of the following specification together with the accompanying drawing wherein.

Figures 1, 2, 3, 4:
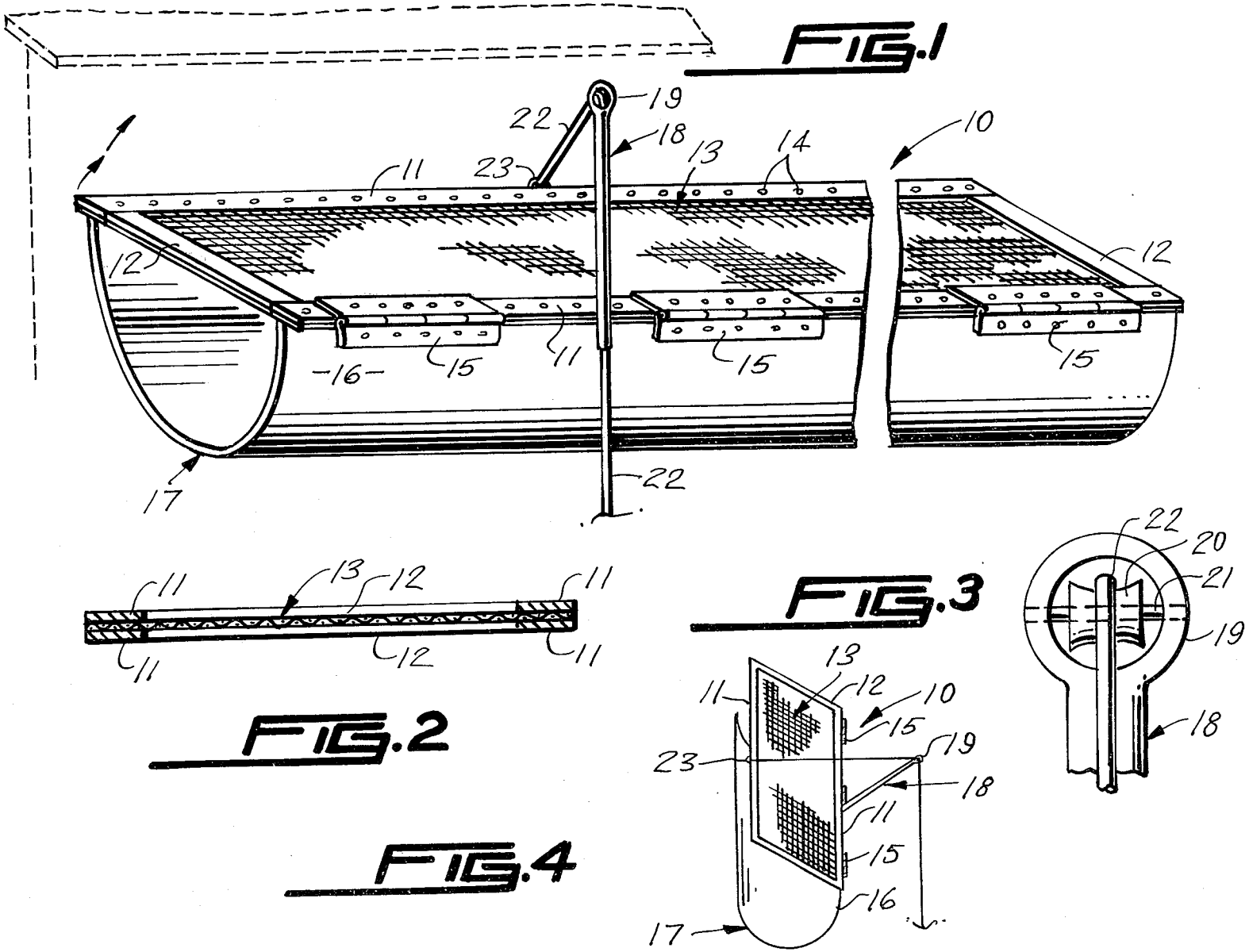
FIG. 1 is a perspective view of the present invention showing the screen member after being returned by the spring loaded hinges.
FIG. 2 is an enlarged cross-sectional view of the screen member shown removed from FIG. 1.
FIG. 3 is an enlarged fragmentary view of the sleeve, pulley and cable arrangement of the invention, shown in elevation.
FIG. 4 is a diagrammatic perspective view showing the screen member partially open.

According to this invention, a safety gutter protection device 10 is shown to include on each side of device 10, a pair of longitudinal and galvanized strips 11 which are parallel to each other and are secured to end strips 12 at each end. The screen member 13 is secured between the frames formed by the galvanized strips 11 and 12 and is secured fixedly thereto by spot welds 14. A plurality of spaced apart and spring loaded hinges 15 have one leaf secured fixedly to one side 16 of gutter 17 by suitable fastening means and the other leaf secured to one longitudinal side of the frame formed by strips 11 and 12. A tube 18 is secured fixedly in a suitable manner to the side 16 of gutter 17 and is provided with an eye 19 at its upper extremity. A rotatable pulley 20 is freely received upon pin 21 of eye 19 and pulley 20 is rolling engagement with cable 22 or a suitable nylon cord. The cable 22 is secured fixedly to screw fastener 23 which is welded or fixedly secured to the opposite side of gutter 17.

When leaves or other debris accumulate upon the screen 13, the user pulls downwards upon the cable 22 which lifts screen 13 pivotably upwards against the spring loaded hinges 15, thus dumping the leaves and other debris upon the ground. When cable 22 is released, the spring loaded hinges 15 will automatically return screen 13 to its normal horizontal position upon the gutter 17.

What I now claim is:

1. In combination with a house having sidewall and an overhanging roof with an eave, a safety gutter protection device, comprising an elongated horizontally disposed eaves trough positioned adjacent the eave extending underneath the overhanging roof portion above said eave, said eaves trough having spaced sidewalls and a bottom portion therebetween with the inner sidewall being disposed adjacent the sidewall of the house inwardly of and below the overhanging roof portion; a rectangular frame comprised of a pair of elongated, parallel side members and a pair of parallel, spaced apart end members secured to the ends of said parallel side members to form a central opening; a mesh screen secured to said frame and overlying said opening to provide a cover therefor, the inner and outer of said side members of said frame resting upon the corresponding inner and outer sidewalls of said eaves trough; a plurality of hinges pivotally mounting the outer side member of said frame to said outer sidewall of said eaves trough for pivotal movement of said inner side member of said frame upwardly from and downwardly into abutment with said inner sidewall of said eaves trough, the spacing of said eaves trough below said overhanging roof portion and from said house sidewall permitting sufficient pivoting of said frame to discharge leaves and the like accumulated on the surface thereof, said hinges being spring-loaded for normally urging said frame to bear downwardly against the inner sidewall of said eaves trough; mounting means on said frame adjacent the inner side member thereof; support means secured to the outer sidewall of said eaves trough and extending thereabove; and elongated flexible cable means secured to said mounting means upwardly to adjacent the upper end of said support means and thence downwardly outwardly of said outer sidewall of said eaves trough and therebelow, said flexible cable means when pulled downwardly manually pivoting the inner end of said frame upwardly from said eaves trough against the biasing pressure of said hinges for discharge of leaves and the like accumulated thereon.

2. The combination of claim 1 wherein said support means has a pulley adjacent the upper end thereof about which said flexible cable means extends.

3. The combination of claim 1 wherein said support means is tubular and wherein said flexible cable means extends downwardly therethrough.

* * * * *